US005085265A

United States Patent [19]

Yamamoto et al.

[11] Patent Number: 5,085,265

[45] Date of Patent: Feb. 4, 1992

[54] METHOD FOR CONTINUOUS CASTING OF MOLTEN STEEL AND APPARATUS THEREFOR

[75] Inventors: Hironori Yamamoto; Chitoshi Matsumura; Kentaro Mori, all of Kawasaki, Japan

[73] Assignee: NKK Corporation, Tokyo, Japan

[21] Appl. No.: 672,373

[22] Filed: Mar. 20, 1991

[30] Foreign Application Priority Data

Mar. 23, 1990 [JP] Japan ..... 2-74342

[51] Int. Cl.[5] ..... B22D 27/02

[52] U.S. Cl. ..... 164/468; 164/504

[58] Field of Search ..... 164/502, 503, 504, 466, 164/467, 468

[56] References Cited

U.S. PATENT DOCUMENTS 4,273,180 6/1981 Tertishnikov et al. ..... 164/503
4,523,627 6/1985 Cans et al. ..... 164/503
4,530,404 7/1985 Vives ..... 164/467

FOREIGN PATENT DOCUMENTS 1-215439 8/1989 Japan ..... 164/503

*Primary Examiner*—Kuang Y. Lin
*Attorney, Agent, or Firm*—Frishauf, Holtz, Goodman & Woodward

[57] ABSTRACT

An apparatus for continuous casting of molten steel comprises a continuous casting mold; an electromagnetic stirring coil, which rotates and fluidizes molten steel inside the mold and which is installed outside the mold; and a screen of ferromagnetic substance positioned between the mold and the electromagnetic stirring coil at a height including a level of meniscus. A method for continuous casting of molten steel comprises the steps of pouring molten steel into a continuous casting mold; applying an electromagnetic force to the molten steel in the mold by means of an electromagnetic coil installed outside the continuous casting mold; and shielding said electromagnetic force by means of a screen of ferromagnetic substance installed between the mold and electromagnetic coil at a height including a level of meniscus.

16 Claims, 7 Drawing Sheets

METHOD FOR CONTINUOUS CASTING OF MOLTEN STEEL AND APPARATUS THEREFOR

BACKGROUND OF THE INVENTION

1. Field of the Invention

The present invention relates to a method for continuous casting of molten steel and apparatus therefor, and more particularly to a method for continuously casting molten steel by electromagnetically stirring molten steel and apparatus therefor.

2. Description of the Related Arts

As a method for minimizing center segregations of solidification structure by increasing fine equi-axed crystals, there are pointed out a low-temperature casting method and an electromagnatic stirring method. In the low-temperature casting method, inhomogeneous nuclei are easily produced by making superheating of the molten steel as small as possible during casting of liquid metal. This method wherein fine equi-axed crystals can be obtained is known as the simplest method for improving the solidification structure.

In the elecromagnetic stirring method, the equi-axed crystal structure is obtained by dividing dendrite arms by forcedly flowing molten steel adjacent to a solidification interface. As the electromagnetic stirring method, there are pointed out a linear motor type, rotary type and magnetostatic field type electromagnetic stirring methods. In the linear motor type and rotary type electromagnetic stirring methods, a shifting magnetic field is applied to molten steel, and the molten steel is forcedly flowed by an interaction of an eddy current generated in the molten steel with the applied magnetic field. In the magnetostatic electric field type electromagnetic stirring method, Lorentz's force is obtained by constantly feeding electric current to molten steel, to which a static magnetic field is applied.

FIG. 7 is an explanatory view showing a situation wherein molten steel adjacent to a meniscus inside a continuous casting mold is stirred by the rotary type electromagnetic stirring apparatus along the inner circumferential surfaces of the mold.

An electromagnetic stirring coil 22 surrounding the continuous casting mold 21 is positioned at a level of a height containing the meniscus of the molten steel outside the continuous casting mold 21. The molten steel is stirred by generating a rotating magnetic field inside the mold by means of the electromagnetic coil 22. Dendrite arms generated along the inner circumferential surfaces of the mold 21 are divided by this stirring whereby an equi-axed crystal structure is obtained.

An electromagnetic stirring force has to be increased to increase the ratio of equi-axed crystals. Since molten steel adjacent to the inner circumference of the mold is raised by a centrifugal force as shown in FIG. 7 when the electromagnetic stirring force is increased, the thickness of a powder pool 24 of lubricating powder on the molten steel 23 inside the continuous casting mold 21 becomes small. Unmelted powder is entrapped into the molten steel whereby slag spots are generated. As the result that powder flows non-uniformly into between the mold 21 and a solidified shell since air is included into the powder, the powder pool being flowed, the rate of solidification of the molten steel becomes small in parts. In consequence, longitudinal cracks are generated on the surface of a billet.

Further, when a flow of molten steel is generated in front of the solidified shell by the use of an electromagnetic stirring apparatus, a negative segregation zone is generated since a concentrated molten steel among the dendrites is washed.

Japanese Patent Publication Laid Open No. 70361/89 discloses a method wherein an electromagnetic coil is arranged in an outer circumference of a continuous casting mold and a round electrically conductive ring is arranged adjacent to a meniscus of the molten metal to apply perpendicularly and upwardly a magnetic field to molten metal. However, this method does not relate to the rotating elecromagnetic stirring method.

SUMMARY OF THE INVENTION

It is an object of the present invention to provide a rotating electromagnetic stirring method wherein the ratio of equi-axed crystals can be raised without generating any slag spot and longitudinal crack in steel and an apparatus therefore.

To attain the aforementioned object, the present invention provides an apparatus for continuous casting of molten steel, comprising:

- a continuous casting mold;
- an electromagnetic stirring coil, which rotates and flows molten steel inside said mold and which is installed outside said mold; and
- a screen of ferromagnetic substance positioned between said mold and the electromagnetic stirring coil at a height including a level of meniscus.

The present invention further provides a method for continuous casting of molten steel, comprising the steps of:

- pouring molten steel into a continuous casting mold;
- applying an electromagnetic force to the molten steel in said mold by means of an electromagnetic coil installed outside the continuous casting mold; and
- shielding said electromagnetic force by means of a screen of ferromagnetic substance arranged between said mold and electromagnetic coil at a height including a level of meniscus.

The above objects and other objects and advantages of the present invention will become apparent from the following detailed description, taken in conjunction with the appended drawings.

BRIEF DESCRIPTION OF THE DRAWINGS

FIG. 4 (B) is a graphical representation designating the relationship between the electric current of the electromagnetic stirring coil and the index of the longitudinal cracks according to the present invention;

FIG. 4 (C) is a graphical represenation designating the relationship between the electric current of the electromagnetic stirring coil and the index of slag spots according to the present invention;

DESCRIPTION OF THE PREFERRED EMBODIMENT

The apparatus for continuous casting of molten steel of the present invention comprises a continuous casting mold, an electromagnetic stirring coil and a screen of ferromagnetic substance. The electromagnetic stirring coil is installed outside the mold to cause molten steel inside the mold to rotate and to be flowed. The screen is positioned between the mold and the electromagnetic stirring coil at a height including a level of meniscus.

The reason for the arrangement of the aforementioned screen is as follows:

When a great stirring force is imparted to enhance the ratio of equi-axed crystals by the rotating electromagnetic stirring apparatus without any center segregation, the thickness of the powder pool on the molten steel is decreased since the molten steel adjacent to the inner circumferential surface of the mold is raised by a centrifugal force. Since the thickness of the pool is decreased, slag spots and longitudinal cracks are generated in a billet. Accordingly, it is sufficient to weaken the stirring force of the molten steel adjacent to the miniscus so that the thickness of the powder pool cannot be decreased. The periphery of the powder pool is prevented from swelling. It is sufficient to absorb a magnetic flux acting on the periphery of the meniscus. In the apparatus for continuous casting of molten steel, a screen of ferromagnetic substance such as pure iron, steel or the like is installed between the electromagnetic stirring coil and the continuous casting mold around the mold at a height including a level of meniscus. The magnetic flux passing through a portion of the meniscus is shielded by the screen.

Figure 8:
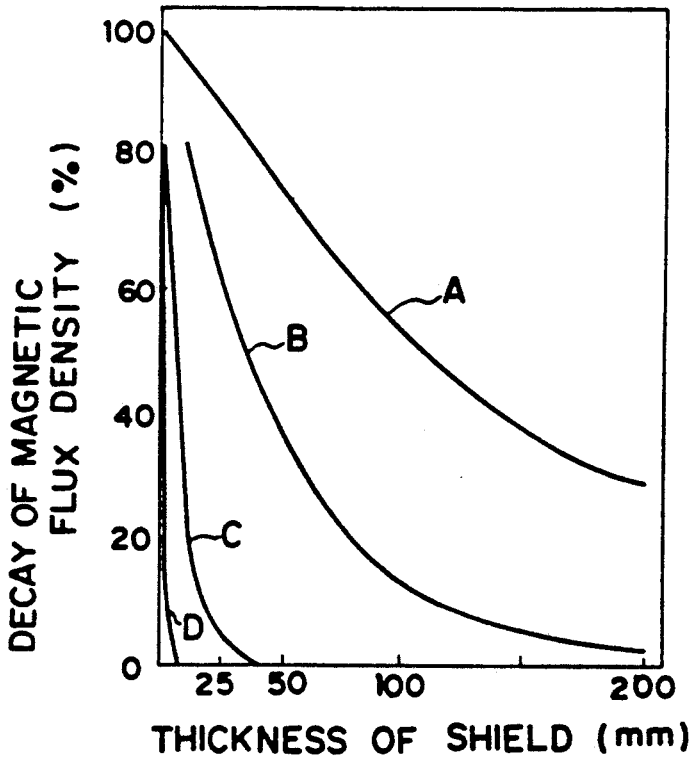
FIG. 8 is a graphical representation designating the relationship between the thickness of a shield and the decay ratio of the magnetic flux density.

FIG. 8 is a graphical representation designating the relationship between the thickness of materials shielding the molten steel from the magnetic flux when the frequency of electrical current caused to pass through the electromagnetic stirring coil is 50 Hz and the decay ratio of the magnetic flux density. In the drawing, A denotes the case of air, B the case of stainless steel of austenite of 1000° C., and C the case of iron of 30° C. When the ferromagnetic substance such as pure iron, steel or the like is used, the magnetic flux does not pass substantially through the materials shielding the molten steel when the molten steel is shielded by a plate of from 10 to 25 mm in thickness. As for the frequency of electric current caused to pass through the electromagnetic stirring coil, a low-frequency power source of from 2 to 20 Hz is desired to be used to prevent the magnetic flux density from damping in a mold of copper plate. The degree of absorption of the magnetic flux by the ferromagnetic substance is equal to that in FIG. 8.

Figure 1:
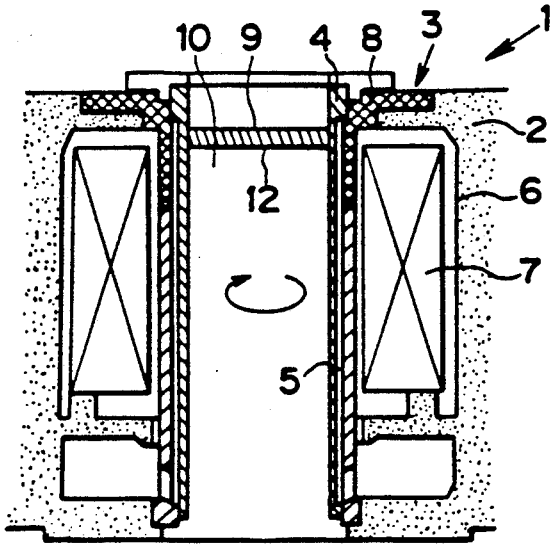
FIG. 1 is a vertical sectional view illustrating an apparatus for continuous casting of molten steel of the present invention.

The apparatus for continuous casting of molten steel of the present invention will now be described with specific reference to FIG. 1.

The apparatus for continuous casting of molten steel is composed of an outer vessel 2 positioned most outside, an inner vessel 3 inserted into the outer vessel 2 and a tubular mold 4 which is inserted into the inner vessel 3 and forms a solidification shell from molten steel by contacting the molten steel. A cooling water path 5 is formed between the inner vessel 3 and the tubular mold 4, which is constantly cooled by cooling water. A ring-shaped concave portion 6 is positioned in a portion where the outer vessel 2 contacts the inner vessel 3 in the continuous casting mold. An electromagnetic stirring coil 7 is installed in the concave portion 6. The inner vessel is composed of an upper portion and a lower portion. The upper portion of the inner vessel 3 is a screen 8 made of common steel of ferromagnetic substance such as steel SS 41 or the like. The common steel in the upper portion of the inner vessel is connected to stainless steel in the lower portion of the inner vessel by welding. In this Preferred Embodiment, the above-mentioned screen of ferromagnetic substance is positioned in the range of from the top end of the mold to a position of 200 mm from the top end of the mold. That is, the screen is positioned in the range which ranges 100 mm upwardly and downwardly with the height of the meniscus as the center.

Figure 2:
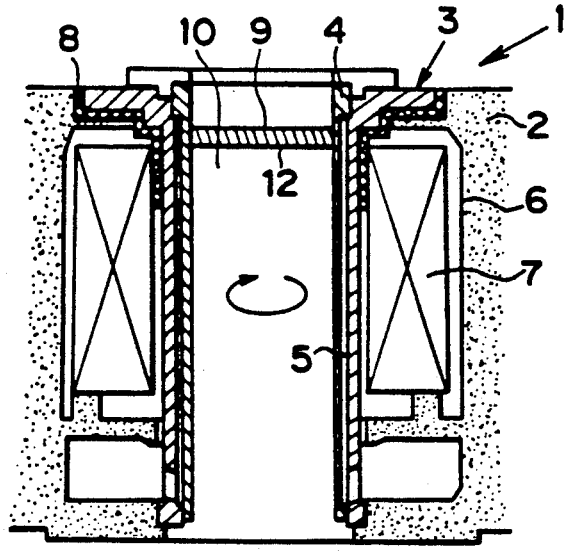
FIG. 2 is a vertical sectional view illustrating another apparatus for continuous casting of molten steel of the present invention.

If there is a gap large enough to put the screen into between the inner vessel 3 and the electromagnetic stirring coil 7, a screen of common steel is wound around the outer surface of the inner vessel of stainless in the form of a headband as shown in FIG. 2 and can be fixed to the inner vessel 3 by bolts or the like. When the screen 8 is put between the mold 4 and the coil 7, elecromagnetic energy absorbed by the screen 8 converts to heat. However, since the screen 8 together with the mold 4, the inner vessel 3 and the coil 7 are cooled by water, the screen cannot be overheated. Pure iron, common steel, ferrite, cobalt, nickel or the like is used for the screen.

A three-phase two-poles electromagnetic stirring coil 7 of 561 mm in outside diameter, 350 mm in inside diameter and 400 mm in length having a maximum coil capacity of 1000 Gauss was used. In this example, a three-phase two-poles coil 7 was used.

A two-phase two poles of three phase four-poles electromagnetic coil can be used.

Figure 10A:
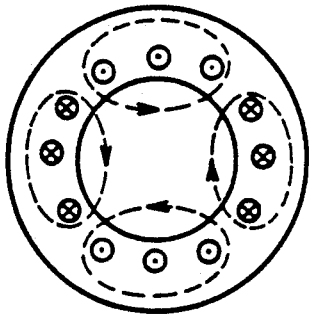
FIG. 10 (A) to (C) are schematic illustration showing a distribution of magnetic flux of coil for rotating and flowing molten steel according to the present invention.
Figure 10B:
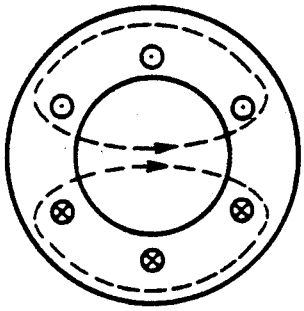
Figure 10C:
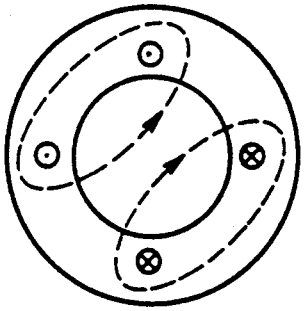

A distribution of magnetic flux in coils flowing rotationally molten steel is shown in FIG. 10 (A) to (C). FIG. 10 (A) shows a case of using a three-phase four-poles electromagnetic coil, FIG. 10 (B) a case of using a three-phase two poles electromagnetic coil and FIG. 10 (C) a case of using a two-phase two-poles electromagnetic coil.

Subsequently, a method for producing steel by the use of the continuous casting apparatus of the present invention will now be described.

Figure 3:
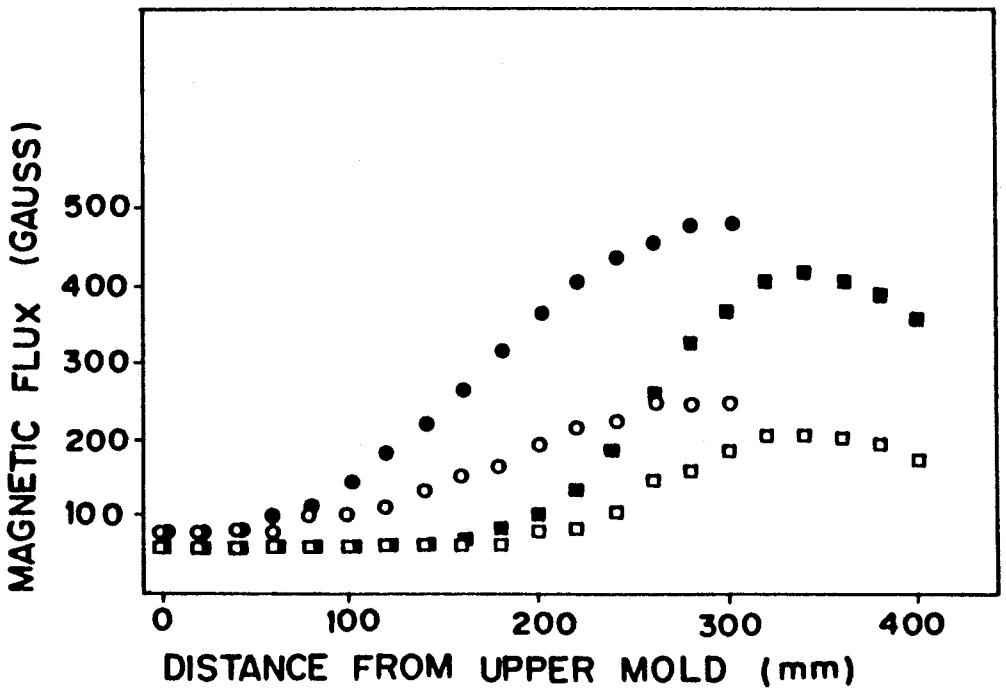
FIG. 3 is a graphical representation designating the relationship between the distance of from the top end of a mold to the lower side thereof and themagnetic flux density according to the present invention.

FIG. 3 is a graphical representation designating the relationship between the distance of from the top end of the mold to the lower side of the mold and the magnetic flux density according to the present invention. Electric current of 100 A and 200 A was passed through the electromagnetic coil 7, and it was studied how the magnetic flux density was changed in the range of from the top end of the mold to the lower side. FIG. 3 shows a case with screen where the magnetic flux density is shown by □ when the electric current was of 100 A and by ■ when the electric current was 200 A. FIG. 3 also shows a case without screen where the magnetic flux density is shown by ○ when the electric current was 100 A and by ● when the electric current was 200 A. When the magnetic flux was not shielded by the screen of ferromagnetic substance, the magnetic flux density became large at a position of 100 mm downward from the top end of the mold, that is, from a position adjacent to the meniscus of molten steel 10 which powder 9 contacted. Conversely, when the magnetic flux was shielded by the screen, the magnetic flux density was low in the range of from the top end of the mold to a position of 200 mm from the top end of the mold, and large enough to obtain a stirring force at a position downward from the position of 200 mm downward from the top end of the mold. A flow velocity of the molten steel in the portion of the meniscus was 20 cm/sec., which was a flow velocity enabling the powder to uniformly flow into the molten steel. The flow velocity of the molten steel was 80 cm/sec. at a depth of 500 mm from the top end of the mold. A sufficient stirring force could be obtained by this flow velocity.

The maximum magnetic flux density applied to the molten steel is desired to be from 200 to 800 Gauss.

Figure 4A:
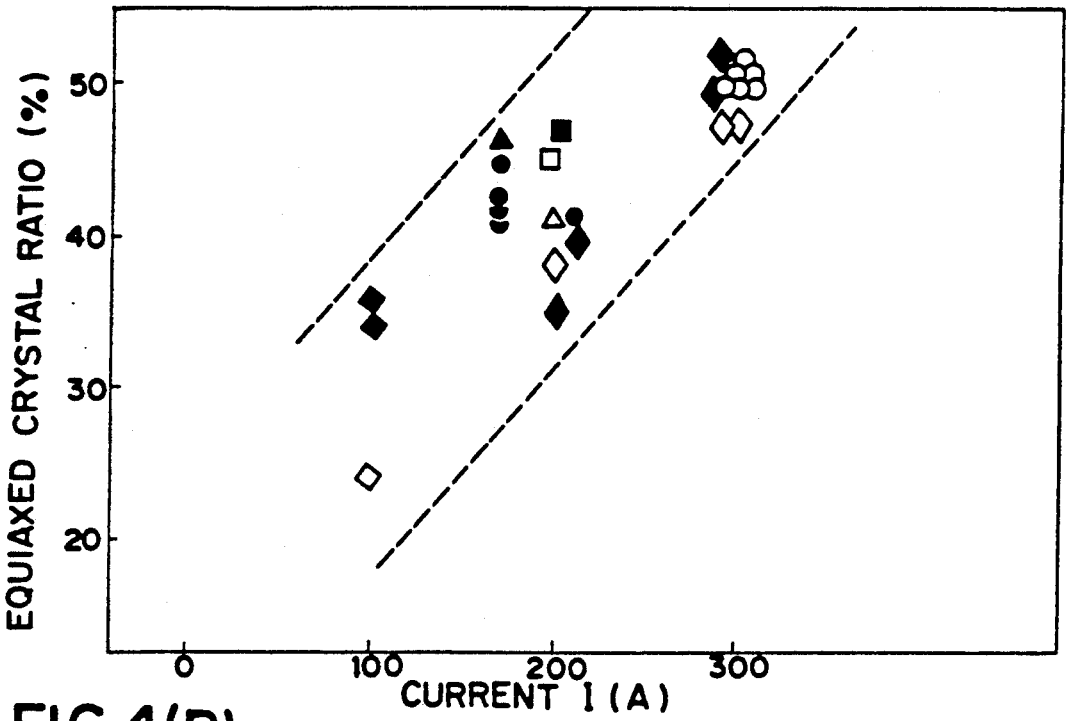
FIG. 4 (A) is a graphical representation designating the relationship between the electric current of the electromagnetic stirring coil and the ratio of equi-axed crystals according to the present invention.
Figure 4B:
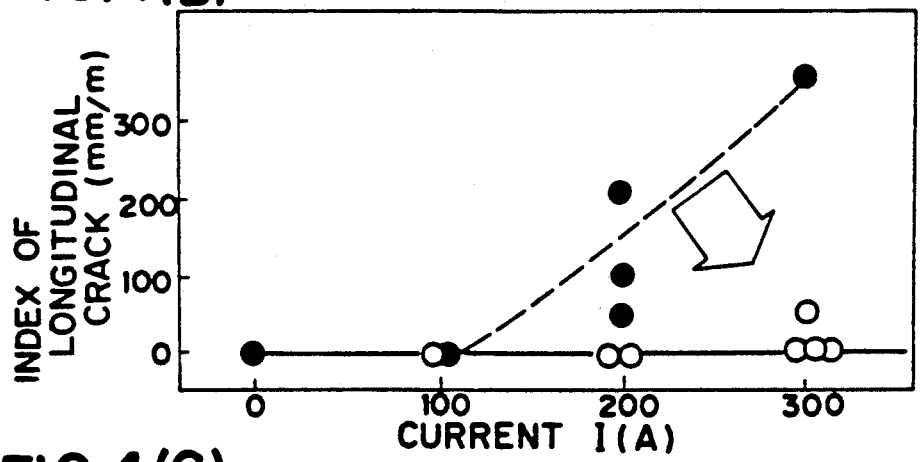
Figure 4C:
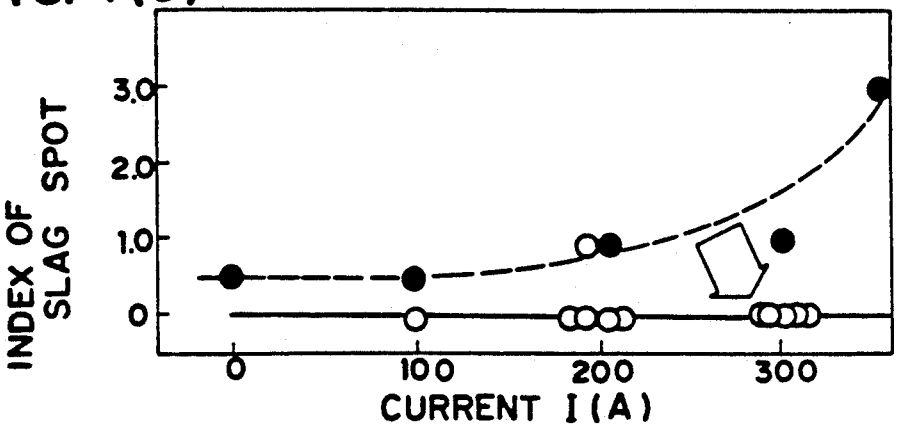

FIG. 4 (A) to (C) are graphical representations designanting the relationship between the inner property and surface quality of a billet when the billet having a chemical composition corresponding to that of carbon steel S 45 C for mechanical structure and a size of 170 mm in diameter was produced at a casting speed of 1.8 m/min. The carbon steel contained 0.45 wt.% carbon and 0.8 wt.% manganese.

FIG. 4 (A) is a graphical representation designating the relationship between the electrical current of the electromagnetic stirring coil and the ratio of area of equi-axed crystals. The ratio of area of equi-axed crystals is obtained by revealing a macro-structure of steel by applying a hydrochloric acid treatment to a section of a billet, measuring a thickness of accumulation of the equi-axed crystals and finding the ratio of area of the equi-axed crystals to the section of the slab. As shown in Table 1, symbols in FIG. 4 are distinguished by superheating degrees ΔT ( ° C.) from a liquidus line of steel and cases with screen and without screen.

TABLE 1

| | ΔT (°C.) | | | |
|---|---|---|---|---|
| | 10~20 | 20~30 | 30~40 | 40~ |
| with screen | □ | Δ | ○ | ◇ |
| without screen | ■ | ▲ | ● | ◆ |

Generally, to increase an inner cleanliness of a billet produced by casting, it is good that ΔT is about 20° C. or more. Conversely, it is said that when ΔT is increased, the ratio of area of equi-axed crystals is lowered. Since the ratio of area of equi-axed crystals is not decreased in the method for continuous casting of molten steel even when ΔT is increased, steel whose ratio of area of equi-axed crystals is large and whose cleanliness is high can be obtained.

FIG. 4 (B) is a graphical representation designating the relationship between the electric current of the electromagnetic stirring coil and the index of the longitudinal cracks. The index of the longitudinal cracks is a value (mm/m) obtained by applying a slight hydrochloric acid teatment to the surface of a billet, finding a total amount of lengths of the longitudinal cracks revealed, dividing the total amount of lengths of the longitudinal cracks by the length of the billet.

In the drawing, symbol ○ denotes a case with screen and symbol ● a case without screen.

FIG. 4 (C) is a graphic representation designanting the relationship between the electric current of the elecromagnetic stirring coil and the index of the slag spots. The index of the slag spots is a value ( number/m) obtained by cutting the outer surface of a billet by 1 mm, finding a total number of inclusions of unmelted powder or molten powder, which appear on cut surface of the billet and dividing the total number of inclusions by the length of the billet. In the drawing, symbol ○ denotes a case with screen and symbol ● a case without screen.

As clearly seen from FIG. 4 (B) and FIG. 4 (C), both the index of the slag spots ( number/m ) and the longitudinal cracks ( mm/m ) do not become worse even when the value of electric current, namely, the stirring force is increased. That is, it is shown that the inner property of the billet can be enhanced, keeping the ratio of are of equi-axed crystals as shown in FIG. 4 (A) at the same level as that in the prior art electromagnetic stirring.

Figure 5:
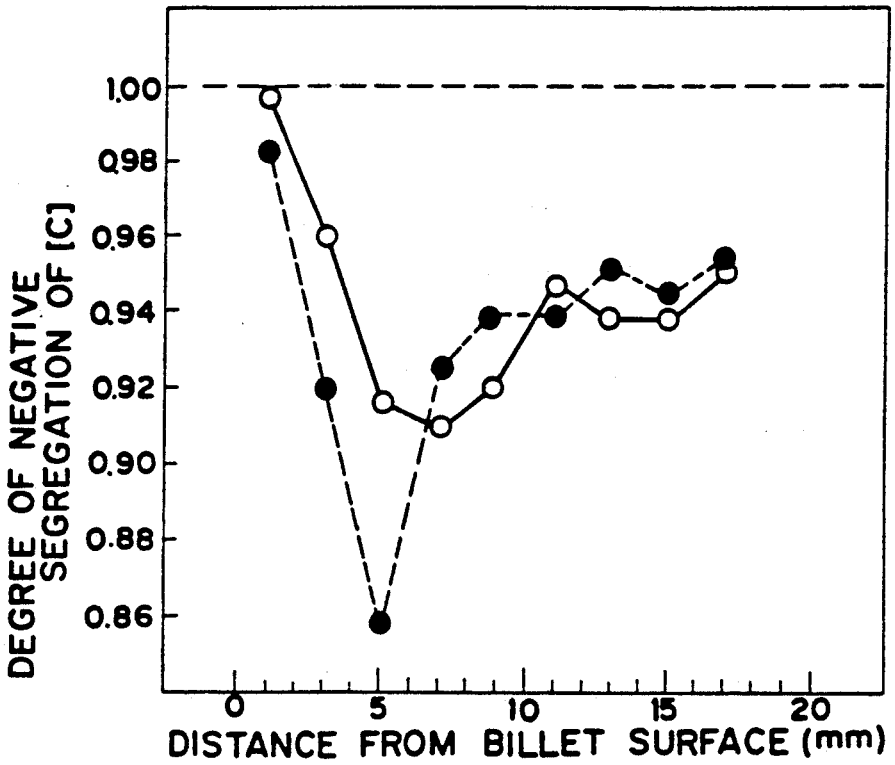
FIG. 5 is a graphical representation designating the distribution of concentration of carbon in the radial direction of a billet according to the present invention.

FIG. 5 is a graphical representation showing the distribution of carbon in the radial direction of the billet when the billet was produced by electromagnetically stirring molten steel with coil current of 300 ampere (A)by using the continuous casting apparatus of the present invention. The section of the billet was 170 mm. The casting speed was 1.5 m/min. In the drawing, symbol ○ denotes a case with screen and symbol ● a case without screen. When molten steel before solidification is generally flowed by using an electromagnetic stirring apparatus, a negative segregation zone is generated because concentrated molten steel before a solid phase is taken away. When this negative segregation zone is generated, the size of the billet is not stable in the case of plastic working of the billet due to the change of properties of the billet in the radial direction thereof in the case of the occurrence of the negative segregation zone. Since the hardness of steel is lowered in the negative segregation zone, for example, the size of the steel is not stable after the working of the steel. As shown by a white circle ( ○ ) in FIG. 5, when the continuous casting apparatus using the screen of the present invention is used, this negative segregation is decreased whereby a billet having a highly homogeneous property under the surface layer of the billet.

Figure 6:
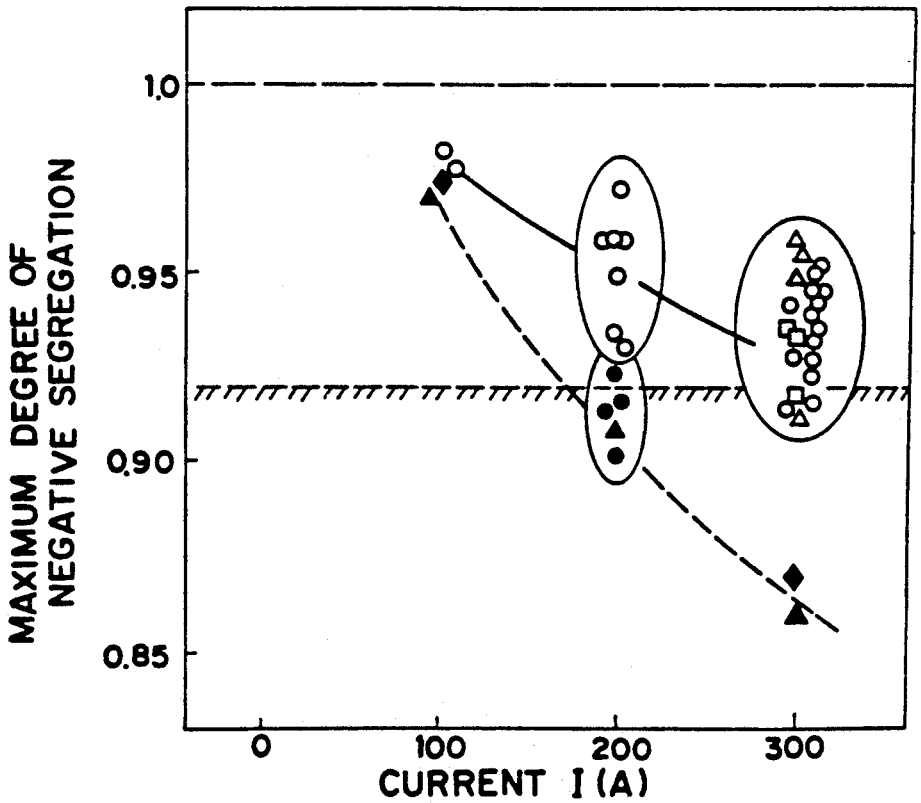
FIG. 6 is a graphical reprsentation designating the relationship between the electric current of the electromagnetic stirring coil and the maximum degree of negative segregation according to the present invention.
Figure 7:
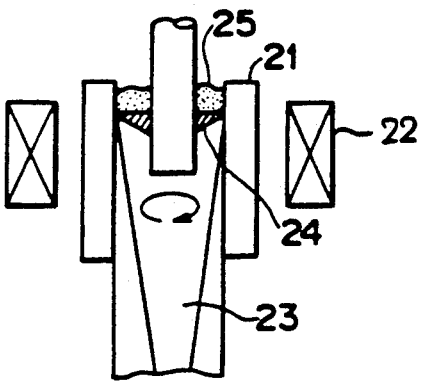
FIG. 7 is a schematic illustration showing a prior art rotating electromagnetic stirring apparatus.

FIG. 6 is a graphical representation designating the relationship between the maximum value of the negative segregation and the effect of the present invention. Symbols in the drawing are distinguished by the casting speed ( m/min) and cases with screen and without screen and shown in Table 2.

TABLE 2

| | Vc (m/min) | | | |
|---|---|---|---|---|
| | 1.2 | 1.5 | 1.8 | 2.0 |
| With screen | □ | Δ | ○ | — |
| Without screen | ■ | ▲ | ● | ◆ |

As seen from symbols □, Δ and ○, when the screen is used, the maximum degree of the negative segregation is 0.92 or more, which is practically unharmed. Judging by combining FIG. 6 with FIG. 3 (A) to (C), it is understood that the billet is suerior in its inner property to the billet in the case without screen, and the billet having a high homogeneity under the surface layer of he billet is produced.

Figure 9:
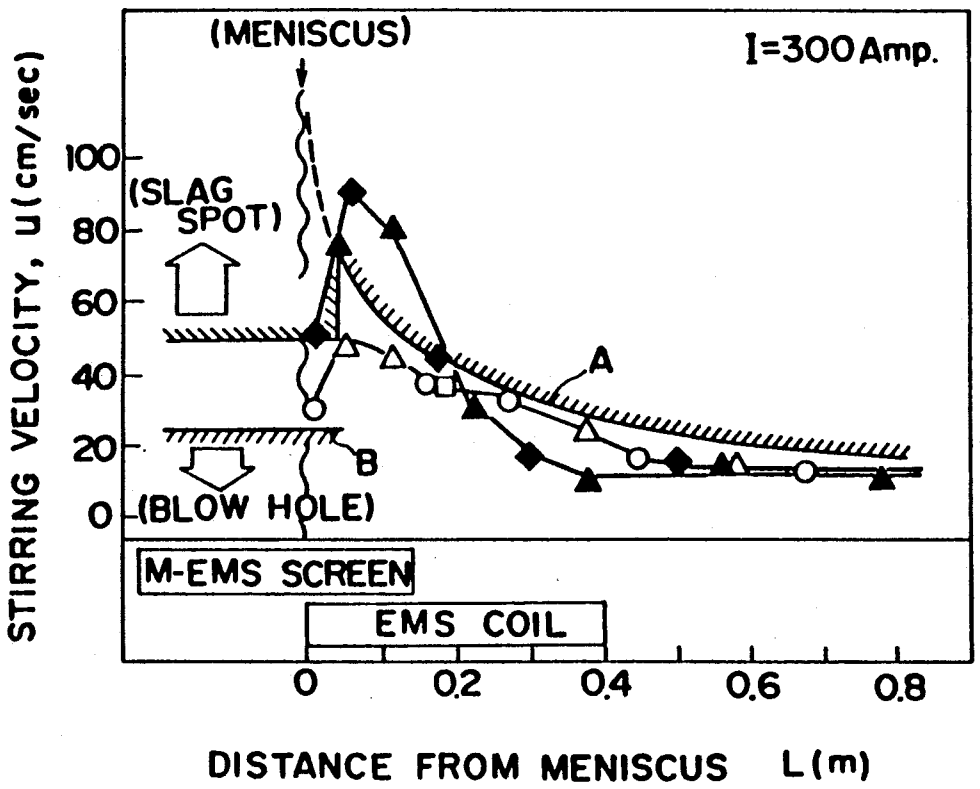
FIG. 9 is a graphical representation showing the relationship between the distance from the meniscus and the stirring flow velocity according to the present invention.

FIG. 9 is a graphical representation showing the relationship between the distance from meniscus and the stirring velocity. Symbols in the drawing are distinguished by the casting speed (m/min. ) and the case with screen and the case without screen. The symbols are the same as those shown in Table 2. The stirring flow velocity is represented by the following equation:

$$U = 7500 \times \frac{k \times Vc^{\frac{1}{2}}}{2} \times \frac{1}{L^{\frac{1}{2}}} \times \frac{1 - ke}{ke - ko}$$

where

U: stirring velocity

V: solidification rate ke: degree of negative segregation ko: equilibrium distribution coefficient L: distance from meniscus k: solidification coefficient Vc: casting speed In the drawing, A denotes an upper limit of the flow velocity of molten steel and B a lower limit of the flow velocity of the molten steel. The flow velocity of the molten steel in the portion of miniscus is desired to be of from 25 to 50 cm/sec. because slag spots are liable to occur when the flow velocity of the molten steel exceeds 50 cm/sec. and blow holes are liable to occur when the flow velocity of the molten steel is below 25 cm/sec. The stirring velocity is desired to be 70 cm/sec. or less just under the meniscus. When the stirring velocity exceeds 70 cm/sec., an amount of molten steel raised by the centrifugal force adjacent to the inner circumference of the mold is increased and the thickness of powder pool on the molten steel is decreased. Then, unmelted powder is included into the molten steel, which generates slag spots. The stirring velocity of the molten steel is desired to be of from 30 to 45 cm/sec. at a position of 0.2 m downward from meniscus.

White band is not generated in this range.

What is claimed is:

1. An apparatus for continuous casting of molten steel, comprising:

a continuous casting mold;

an electromagnetic stirring coil for generating a shifting magnetic field shifting in a horizontal plane, which rotates and flows molten steel inside said mold and which is installed outside said mold; and a screen of ferromagnetic substance positioned between said mold and the electromagnetic stirring coil at a height including a level of meniscus.

2. The apparatus of claim 1, wherein said screen of ferromagnetic substance constitutes an upper portion of an inner vessel positioned between the continuous casting mold and the electromagnetic stirring coil.

3. The apparatus of claim 1, wherein said screen of ferromagnetic substance is installed in an upper portion of an inner vessel positioned between the continuous casting mold and the electromagnetic stirring coil and outside the inner vessel.

4. The apparatus of claim 1, wherein said screen of ferromagnetic substance is installed in the range of from the top end of the continuous casting mold to a position of 200 mm downward from the top end of the continuous casting mold.

5. The apparatus of claim 1, wherein said ferromagnetic substance is selected from a group consisting of pure iron, common steel, ferrite, cobalt and nickel.

6. The apparatus of claim 1, wherein said screen of ferromagnetic substance has a thickness of from 10 to 25 mm.

7. The apparatus of claim 1, wherein said screen of ferromagnetic substance constitutes an upper portion of an inner vessel positioned between the contiuous casting mold and the electromagnetic stirring coil;

said screen of ferromagnetic substance is installed in the range of from the top end of the continuous casting mold to a position of 200 mm downward from the top end of the continuous casting mold; and said ferromagnetic substance is common steel.

8. A method for continuous casting of molten steel, comprising the steps of:

pouring molten steel into a contiuous casting mold;

applying an electromagnetic force to the molten steel in said mold by means of a shifting magnetic field generated by an electromagnetic coil installed outside the continuous casting mold wherein said magnetic field shifting in a horizontal plane; and shielding said electromagnetic force by means of a screen of ferromagnetic substance installed between said mold and said electromagnetic coil at a height including a level of meniscus.

9. The method of claim 8, wherein said screen of ferromagnetic substance constitutes an upper portion of an inner vessel positioned between the continuous casting mold and the electromagnetic stirring coil.

10. The method of claim 8, wherein said screen of ferromagnetic substance is installed in an upper portion of an inner vessel positioned between the continuous casting mold and the electromagnetic stirring coil and outside the continuous casting mold.

11. The method of claim 8, wherein said screen of ferromagnetic substance is installed in the range of from the top end of the continuous casting mold to a position of 200 mm downward from the top end of the continuous casting mold.

12. The method of claim 8, wherein said screen of ferromagnetic substance is installed in the range of from a position of 100 mm upward from meniscus to a position of 100 mm downward from the meniscus.

13. The method of claim 8, wherein said ferromagnetic substance is selected from a group consisting of pure iron, common steel, ferrite and cobalt.

14. The method of claim 8, wherein said screen of ferromagnetic substance has a thickness of from 10 to 25 mm.

15. The method of claim 8, wherein said electromagnetic force has magnetic flux density of from 200 to 800 Gauss.

16. The method of claim 8, wherein said screen of ferromagnetic substance constitutes an upper portion of an inner vessel positioned between the continuous casting mold and the electromagnetic stirring coil;

said screen of ferromagnetic substance is installed in the range of from the top end of the continuous casting mold to a position of 200 mm downward from the top end of the continuous casting mold;

said ferromagnetic substance is common steel; and said electromagnetic force has magnetic flux density of from 200 to 800 Gauss.

* * * * *